US005908278A

United States Patent [19]

Hasan et al.

[11] Patent Number: 5,908,278

[45] **Date of Patent: *Jun. 1, 1999**

[54] STRESS PLATE WITH DEPENDING SLEEVE

[75] Inventors: S. Riaz Hasan, Palatine; Sigismund G. Paul, Park Ridge, both of Ill.

[73] Assignee: Illinois Tool Works Inc., Glenview, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/908,225

[22] Filed: Aug. 7, 1997

[51] Int. Cl.[6] ..... F16B 43/00

[52] U.S. Cl. ..... 411/533; 411/368

[58] Field of Search ..... 411/531–533, 537, 411/544, 545, 371, 372, 368; 52/410, 512

[56] References Cited

U.S. PATENT DOCUMENTS

| | | | |
|---|---|---|---|
| 2,169,182 | 8/1939 | Kost | 85/32 |
| 2,824,480 | 2/1958 | Hotchkin | 85/32 |
| 3,108,371 | 10/1963 | Munse | 29/532 |
| 4,201,111 | 5/1980 | Kuttler | 85/32 |
| 4,361,997 | 12/1982 | DeCaro | 52/512 |
| 4,380,413 | 4/1983 | Dewey | 411/161 |
| 4,453,361 | 6/1984 | Hylsey | 52/410 |
| 4,508,477 | 4/1985 | Oehlke et al. | 411/174 |
| 4,518,293 | 5/1985 | Pleickhardt et al. | 411/107 |
| 4,693,654 | 9/1987 | Bettini | 411/387 |
| 4,781,503 | 11/1988 | Bogel | 411/368 |
| 4,797,045 | 1/1989 | Lautenschlager | 411/533 |
| 4,799,322 | 1/1989 | Sygnator | 411/533 |
| 4,809,568 | 3/1989 | DeCaro | 81/57.37 |
| 4,884,932 | 12/1989 | Meyer | 411/533 |
| 4,907,927 | 3/1990 | Choiniere | 411/368 |
| 5,066,181 | 11/1991 | Bogel | 411/533 |
| 5,082,412 | 1/1992 | Thomas | 411/533 |
| 5,102,275 | 4/1992 | Hulsey | 411/134 |
| 5,122,022 | 6/1992 | RemoKluser | 411/446 |
| 5,217,339 | 6/1993 | O'Connor | 411/533 |
| 5,378,102 | 1/1995 | Mossman | 411/531 |
| 5,517,883 | 5/1996 | Goldl | 81/57.37 |
| 5,607,272 | 3/1997 | Olvera | 411/533 |
| 5,662,444 | 9/1997 | Schmidt | 411/533 |
| 5,664,922 | 9/1997 | Janssen | 411/533 |
| 5,688,092 | 11/1997 | Olvera | 411/533 |

FOREIGN PATENT DOCUMENTS

| | | |
|---|---|---|
| 21133 | 6/1971 | Japan . |

*Primary Examiner*—Flemming Saether
*Assistant Examiner*—Gary Estremsky
*Attorney, Agent, or Firm*—Schwartz & Weinrieb

[57] ABSTRACT

A stress plate for use with a threaded fastener for securing relatively soft insulation to a solid base, such as in a roofing environment, includes a generally planar main body with an underside, an aperture on the main body configured for receiving the fastener, and a sleeve circumscribing the aperture and depending from the underside a sufficient distance to receive the fastener and maintain the fastener perpendicular to the plate, especially when the plate is located intermediate the fastener ends. In the preferred embodiment, the fastener is threaded with a defined pitch of the thread, and the sleeve is dimensioned to span at least one pitch of the fastener.

20 Claims, 1 Drawing Sheet

STRESS PLATE WITH DEPENDING SLEEVE

FIELD OF THE INVENTION

The present invention relates generally to fastening systems for use in securing relatively soft insulation to a solid base, and specifically, to stress plates and associated threaded fasteners used for securing insulation to a building structure.

BACKGROUND OF THE INVENTION

In certain modern roofing installations of commercial and factory buildings having a flat roof design, a layer of insulation is placed on a generally corrugated steel roof deck, and is then covered with a single ply thermoplastic roofing membrane to protect against the elements. Conventional membranes are EPDM, PVC or equivalent materials. Conventional insulation of the type used for roof decks includes ISO, wood fiber board, or pearlite.

The assemblies typically used to secure the insulation generally include a washer-like stress plate made of either plastic or metal and which receives a screw-like fastener that is threaded into the roof deck, thereby clamping the insulation between the stress plate and the roof deck. Since the type of insulation commonly utilized is approximately up to six or even twelve inches thick, it is important to keep the fastener in perpendicular alignment when installing the plate so that the stress plate properly contacts and secures the insulation against blowing off from extreme cyclical loading. Adverse weather conditions such as hurricanes and other storms having high and gusting winds create the extreme high pressure dynamic loading, including uplift, of the sort which such roofing is designed to withstand. In practice, special tools may be used to install the washers and fasteners. An example of such a tool is described in U.S. Pat. No. 4,809,568, and another such tool is sold by ITW Buildex, Itasca, Ill. under the trademark ACCUFAST.

In a typical installation, the stress plates and fasteners are delivered to the job site in separate packages. Next, the installer obtains a supply of plates and fasteners, and lays out the plates on the roof in a specific pattern required by the roofing approval or warranty. Upon completion of that step, the installer installs fasteners through the plates, into the insulation and/or membrane, and eventually into the solid roof base or substrate. In some applications, one type of plate and fastener is used to secure the insulation, and another type of plate and fastener is used to secure the membrane.

A disadvantage of this method of installation is that it requires the installer to spend a significant amount of time to perform the two major steps of separately handling the stress plates and the fasteners. Also, once installed, the alignment of the fasteners relative to the plates and the roof must be maintained under relatively exposed working conditions. Often it is difficult to prevent the fasteners from being threaded into the roof at an angle, which may decrease their ability to secure the roof when exposed to severe weather.

Another disadvantage of conventional stress plates and their associated fasteners relates to the anti-corrosive coating which covers typical fasteners. In some cases, the corresponding hole or aperture in the stress plate is dimensioned so that a tight fit is formed with the fastener. Thus, when the fastener is threaded into the hole, the sharp edges of the hole tend to scrape off or otherwise rupture the anti-corrosive coating. In time, upon exposure to the elements, the fastener corrodes more rapidly, and eventually fails, causing the roof to be more susceptible to severe weather damage.

Another disadvantage of conventional stress plates is that upon installation on a roof, when the roof system is subject to severe weather conditions, such as high winds, the roof insulation may billow or pull on the fastener assembly, creating a stress load. Such stress loading may also affect the plates securing the insulation. In extreme cases, the stress loading has been known to pull the plate over the head of the fastener. Naturally, this type of plate deformation is to be avoided, since it may ultimately lead to failure of the roofing system.

OBJECTS OF THE INVENTION

Thus, it is a first object of the present invention to provide an improved stress plate which is specially designed to hold the fastener at a perpendicular orientation to the roof while it is being installed.

Another object of the present invention is to provide an improved stress plate in which the engagement of the fastener with the opening or hole in the plate will not cause the anti-corrosive coating on the fastener to be scraped off or damaged, while the fastener is still maintained in a perpendicular orientation to the roof during installation.

Still another object of the present invention is to provide an improved fastener assembly for use in securing relatively soft materials to a solid base, such assembly including a stress plate and a fastener preinstalled into the plate and held relative thereto at a perpendicular angle so as to facilitate proper installation.

Yet another object of the present invention is to provide an improved fastener assembly for use in securing relatively soft materials to a solid base, such assembly including a stress plate and a fastener preinstalled into the plate, wherein the plate is reinforced with a sleeve in the area of the plate beneath the fastener head so as to have higher "pull through" values so that the assembly is less susceptible to damage under stress loading of the type occurring in roofing applications.

BRIEF SUMMARY OF THE INVENTION

The above-identified objects are met or exceeded by the present stress plate for use with a threaded fastener in attaching roofing insulation to a roof. A major feature of the stress plate is that it is configured to retain the fastener in a perpendicular orientation to the plate, and ultimately, to the roof. In the preferred embodiment, the stress plate is provided with an annular sleeve which depends from an underside of the plate so as to engage the threads of the fastener. Thus, the present plate holds the fastener in a perpendicular orientation, prevents damage to the fastener's anti-corrosive coating and provides additional structural support to the plate. In addition, the present plate is preferably provided to the installer as an assembly with the fastener threaded into the hole in the plate.

More specifically, a stress plate for use with a threaded fastener for securing relatively soft insulation to a solid base, such as in a roofing environment, includes a generally planar main body with an underside, an aperture on the main body configured for receiving the fastener, and depending side walls or a sleeve circumscribing the aperture and depending from the underside a sufficient distance to receive the fastener and maintain the fastener perpendicular to the plate, especially when the fastener is only partially inserted into the stress plate. In the preferred embodiment, the fastener is threaded with a defined pitch of the thread, and the sleeve is dimensioned to span at least one pitch of the fastener.

In another embodiment, the invention provides a fastener assembly for securing relatively soft insulation to a solid base, including a fastener having a head, a tip and a threaded portion located between the tip and the head. A stress plate has a generally planar main body, an underside, a generally central aperture on the main body configured for receiving the fastener, and a sleeve circumscribing the aperture and depending from the underside a sufficient distance to receive the fastener and maintain the fastener perpendicular to the plate, especially when the fastener is only partially inserted through the plate.

BRIEF DESCRIPTION OF THE SEVERAL VIEWS OF THE DRAWINGS

Various other objects, features, and attendant advantages of the present invention will be more fully appreciated from the following detailed description when considered in connection with the accompanying drawings in which like reference characters designate like or corresponding parts throughout the several views and wherein.

DETAILED DESCRIPTION OF THE INVENTION

Figure 1:
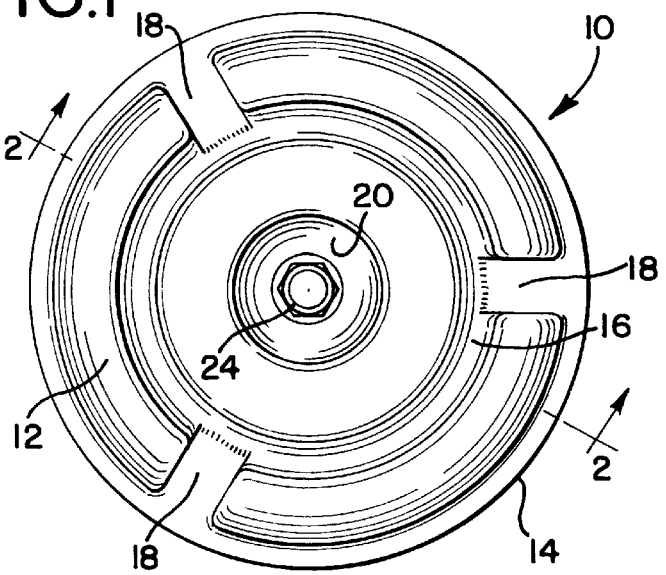
FIG. 1 is an overhead plan view of the present invention stress plate having a fastener engaged therein.
Figure 2:
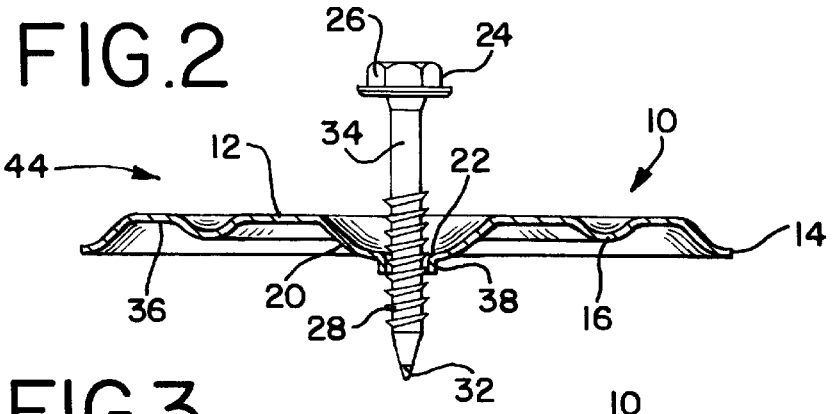
FIG. 2 is a sectional view taken along the line 2—2 of FIG. 1 and in the direction indicated generally.
Figure 3:
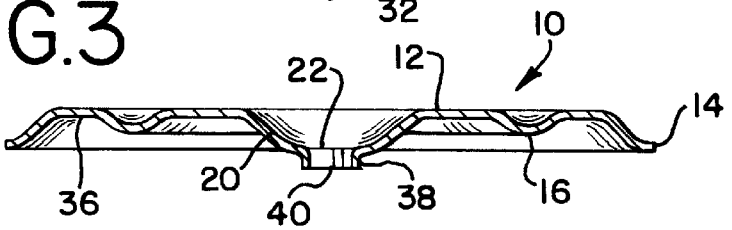
FIG. 3 is a view of the stress plate as depicted in FIG. 2 with the fastener omitted.

Referring now to FIGS. 1–3, a stress plate incorporating the features of the invention is shown and generally designated 10. As described above, this type of plate 10 is designed for use with a threaded fastener for securing relatively soft insulation to a solid base, such as in commercial roofing applications. The plate 10 is relatively rigid, and is made of either metal or plastic, as is well known in the art. In the pictured embodiment, the plate 10 is made of metal, is circular in shape and has a 3.0 inch diameter, however other shapes and sizes are contemplated including oval, square and triangular, depending on the application.

The plate 10 includes a main body 12 with an outer peripheral edge 14 and in a preferred embodiment, at least one strengthening corrugation 16, pictured as an annular ring stamped into the surface of the main body 12, which is generally planar. The outer peripheral edge 14 is vertically spaced from the main body 12 so as to define a declining outer rim. In the preferred embodiment, the plate 10 may also be provided with additional radial rib segments 18 which connect the corrugation 16 with the peripheral edge 14.

A generally conically-shaped depression 20 is preferably positioned centrally on the main body 12, and is of sufficient depth to allow the top of the head of the fastener to be below the top of the rib on the plate. If other fasteners are used, such as those having flat heads, the flat head is preferably located on the main body 12, and the depression 20 is not required.

A generally centrally located aperture or hole 22 is defined by the depression 20 and is configured for receiving a fastener 24. In the preferred embodiment, the aperture 22 is positioned on a central or vertical axis of both the depression and the plate 10. The size or diameter of the aperture 22 will vary with the application and the size of the fastener; however, in the preferred embodiment, the fastener 24 is a No. 12 size, with a thread diameter 'T' of 0.212 inch, a root diameter 'R' (best seen in FIG. 4) of 0.142 inch and the aperture 22 is in the general range of 0.200 inch. Also, although the aperture is preferably circular in shape, depending on the application it is contemplated that other shapes may be employed, including but not limited to oval, triangular or otherwise polygonal.

Referring now to FIG. 2, the fastener 24 is preferably a screw with a hex head 26 at one end, a threaded portion 28 made up of a plurality of helical threads 30, a tip 32 opposite the head 26 and with the threaded portion 28 between the head and tip, and a shank 34 between the head and the threaded portion. In the preferred embodiment, the tip 32 is of a self-tapping configuration and preferably is of the type disclosed in commonly assigned U.S. Pat. No. 4,693,654, which is incorporated herein by reference. In the preferred embodiment, the threads 30 are in the modified buttress form, and are coated with an environmentally resistant protective coating.

Furthermore, while the fastener 24 shown in FIG. 2 is relatively short for purposes of illustration, it is preferred that the fasteners 24 may be provided in any suitable length depending on the application. It is contemplated that the fasteners may fall within the range of 1.5 to 14 inches in length. Suitable fasteners are manufactured and sold by ITW Buildex, Itasca, Ill., under the trademark HEXTRA.

Figure 4:
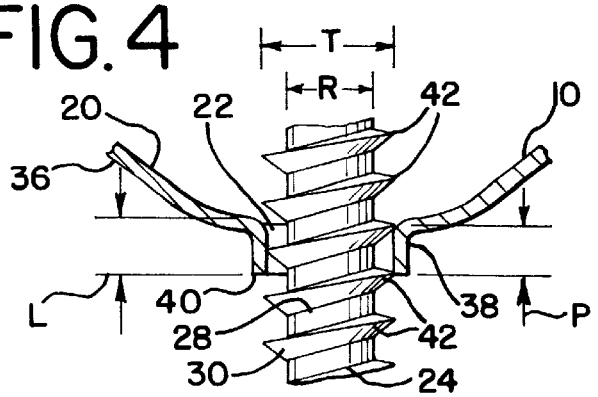
FIG. 4 is an enlarged fragmentary view of a portion of FIG. 2 depicting the relationship between the fastener threads and the sleeve.

Referring now to FIGS. 2–4, an important feature of the present stress plate 10 is that an underside 36 of the plate 10 is provided with a sleeve or depending side walls 38 circumscribing the aperture 22. Depending from the underside 36 a sufficient distance to receive the fastener 24, the sleeve maintains the fastener perpendicular to the plate 10. As described above, the perpendicular orientation of the fastener 24 relative to the plate 10, while the fastener is engaged in the plate so that the plate is intermediate the ends of the fastener, is a key factor in efficient installation of commercial roofing using this type of fastener. Also, a lower edge 40 of the sleeve depends below the peripheral edge 14 of the plate 10. In the preferred embodiment, the plate 10 is fabricated by stamping a sheet of galvanized steel, aluminum or other suitable metal, with the sleeve an integral part of the plate and formed in the stamping operation. Alternately the plate 10 and the sleeve 38 may be molded of a durable and environmentally resistant plastic, and the sleeve is integrally formed in such operation.

Referring now to FIG. 4, the fastener 24 is provided with threads 30 which have a specified pitch "P", defined as the distance between adjacent flights 42 of the thread and measured along a vertical line defined by the outer periphery of the threads 30. In the preferred embodiment, the sleeve 38 is dimensioned with a length "L" dimensioned to span approximately at least one pitch of the fastener. More specifically, in the preferred embodiment, the pitch "P" is approximately 0.080 inch, and the length "L" is approximately 0.085 inch. It has been found that this length of the sleeve is sufficient to maintain the fastener 24 perpendicular to the plate 10, and also does so without shaving, penetrating or otherwise damaging the protective anti-corrosion coating of the fastener as it threadably engages the aperture 22.

While the sleeve 38 has been depicted as being generally cylindrical in shape, it is contemplated that, depending on the application, alternate shapes may be employed, including but not limited to triangular, square or other polygonal shapes. Further, although the sleeve 38 is shown as a continuous structure, it is also contemplated that it may be formed by a plurality of spaced, depending tabs which taken together will define a sleeve-like shape.

Another advantage of the present invention sleeve 38 is that it strengthens the plate 10 in the area immediately surrounding the aperture 22. It has been found that once the plate 10 is secured to a roof using the fastener 24, the plate is more resistant to a type of deformation known as "pull through", which occurs when the plate is subject to wind-induced loading of the roof insulation secured by the plate and fastener in combination. In extreme cases, the forces on the roof insulation will cause the plate to "pull through" the head of the fastener, and consequently will detach the roof insulation at that point. Once this type of roof is weakened at one point, a domino effect occurs, where greater loading is then applied to the next adjacent fasteners, which may also fail. Eventually, if the weather conditions persist, the entire roofing system may be severely damaged. By providing the sleeve 38, the plate is reinforced in the area beneath the fastener head 26 to resist "pull through" deformation.

In operation, the plates 10 and the fasteners 24 may be provided to the installer in separate packages, or in preassembled form, with the fastener 24 at least partially threaded into the aperture 22 as depicted in FIG. 2. For greater installation efficiency, it is preferred that the plates and fasteners be assembled prior to delivery at the job site, with the fastener driven approximately one-half of the way through the plate. A suitable assembly of fastener and plate is indicated generally in FIG. 2 and is designated 44. The installer then carries a plurality of the assemblies 44 in a suitable container to the job site, places the individual assemblies in their appropriate locations on the roof insulation by punching the fastener tip through the insulation, and proceeds to drive the fasteners into the roof substrate or base using a rotating driver tool as is well known in the art.

An advantage of the present invention stress plate 10 is that the fastener 24 is maintained in a generally vertical position relative to the plate so that the fastener is properly driven into the solid base of the roof deck so as to properly position the stress plate for the proper amount of fastening power. Another advantage of the present invention plate 10 is that due to its configuration, specifically the provision of the sleeve 38, the preassembly of the fastener 24 into the plate will maintain the protective anti-corrosion coating on the fastener and will not remove, fracture or otherwise disturb the coating.

While various embodiments of the present invention stress plate with its depending sleeve have been shown and described, it will be appreciated by those skilled in the art that changes and modifications may be made thereto without departing from the invention in its broader aspects and as set forth in the following claims. It is therefore to be understood that within the scope of the appended claims, the present invention may be practiced otherwise than as specifically described herein.

We claim:

1. A stress plate for use with a threaded fastener for securing a member to a base structure, comprising:

a substantially planar main body disposed within a first plane and having an outer peripheral edge vertically spaced from said first plane defined by said substantially planar main body so as to be disposed within a second plane whereby said stress plate, comprising said substantially planar main body and said outer peripheral edge, has a predetermined thickness dimension, and a recessed portion, having an upper portion commencing substantially within said first plane of said substantially planar main body and a lower portion terminating substantially within said second plane of said outer peripheral edge of said substantially planar main body such that said recessed portion has a depth substantially equal to said predetermined thickness dimension of said stress plate, defined within a substantially central portion of said stress plate for accommodating a head portion of a threaded fastener to be inserted through said stress plate in order to secure a member to a base structure;

an aperture defined within a substantially central portion of said stress plate and substantially coaxial with said recessed portion of said substantially planar main body for receiving a threaded shank portion of a threaded fastener; and a non-threaded, substantially cylindrical, tubular sleeve means, having opposite upper and lower ends, circumscribing said aperture, and having a predetermined axial length such that said upper end of said non-threaded, substantially cylindrical, tubular sleeve means is integral with said lower portion of said recessed portion of said substantially planar main body such that said non-threaded, substantially cylindrical, tubular sleeve means and said recessed portion of said substantially planar main body comprise a one-piece structure and said upper end of said non-threaded, substantially cylindrical, tubular sleeve means is disposed substantially within said second plane of said outer peripheral edge of said substantially planar main body while said lower end of said non-threaded, substantially cylindrical, tubular sleeve means depends axially downwardly from said recessed portion of said substantially planar main body a predetermined distance below said second plane defined by said outer peripheral edge of said substantially planar main body, for receiving a threaded shank portion of a threaded fastener when a threaded fastener is inserted through said aperture defined within said substantially planar main body and for engaging only the crest portions of a threaded portion of a threaded fastener when a threaded fastener is inserted through said aperture defined within said substantially planar main body so as to maintain a threaded fastener substantially perpendicular to said stress plate.

2. The stress plate as defined in claim 1, wherein:

said sleeve means has a predetermined axial length so as to span approximately one pitch of a threaded fastener when a threaded fastener, having a defined thread pitch, is inserted through said aperture and said sleeve means.

3. The stress plate as defined in claim 1, wherein:

said sleeve means has a predetermined axial length so as to span at least one pitch of a threaded fastener when a threaded fastener, having a defined thread pitch, is inserted through said aperture and said sleeve means.

4. The stress plate as defined in claim 1, wherein:

said aperture of said stress plate has a predetermined diametrical extent so that as a fastener, provided with a protective coating thereon, is axially inserted through said aperture, said aperture does not scrapingly engage the coating whereby the coating is retained upon the fastener.

5. The stress plate as defined in claim 1, wherein:

said sleeve means has a predetermined length so as to provide structural support to said plate for resisting pull through deformation of said plate and thereby prevent pull through of a fastener under adverse conditions impressed upon said stress plate.

6. The stress plate as defined in claim 1 wherein the sleeve is integral with said plate.

7. A fastener assembly for securing a member to a base structure, comprising:

a threaded fastener having a head portion, a tip, and a threaded shank portion located between said tip and said head portion;

a stress plate having a substantially planar main body disposed within a first plane and having an outer peripheral edge vertically spaced from said first plane defined by said substantially planar main body so as to be disposed within a second plane whereby said stress plate, comprising said substantially planar main body and said outer peripheral edge, has a predetermined thickness dimension, and a recessed portion, having an upper portion commencing substantially within said first plane of said substantially planar main body and a lower portion terminating substantially within said second plane of said outer peripheral edge of said substantially planar main body such that said recessed portion has a depth substantially equal to said predetermined thickness dimension of said stress plate, defined within a substantially central portion of said stress plate for accommodating said head portion of said threaded fastener to be inserted through said stress plate in order to secure a member to a base structure;

an aperture defined within a substantially central portion of said stress plate and substantially coaxial with said recessed portion of said substantially planar main body for receiving said threaded shank portion of said threaded fastener; and a non-threaded, substantially cylindrical, tubular sleeve means, having opposite upper and lower ends, circumscribing said aperture, and having a predetermined axial length such that said upper end of said non-threaded, substantially cylindrical, tubular sleeve means is integral with said lower portion of said recessed portion of said substantially planar main body such that said non-threaded, substantially cylindrical, tubular sleeve means and said recessed portion of said substantially planar main body comprise a one-piece structure and said upper end of said non-threaded, substantially cylindrical, tubular sleeve means is disposed substantially within said second plane of said outer peripheral edge of said substantially planar main body while said lower end of said non-threaded, substantially cylindrical, tubular sleeve means depends axially downwardly from said recessed portion of said substantially planar main body a predetermined distance below said second plane defined by said outer peripheral edge of said substantially planar main body, for receiving said threaded shank portion of said threaded fastener when said threaded fastener is inserted through said aperture defined within said substantially planar main body and for engaging only the crest portions of said threaded shank portion of said threaded fastener when said threaded fastener is inserted through said aperture defined within said substantially planar main body so as to maintain said threaded fastener substantially perpendicular to said stress plate.

8. The assembly as defined in claim 7 wherein the fastener is threaded with a defined pitch of the thread, and said sleeve is dimensioned to span at least one pitch of the fastener.

9. The assembly as defined in claim 7 wherein the fastener is threaded with a defined pitch of the thread, and said sleeve is dimensioned to span approximately one pitch of the fastener.

10. The assembly as defined in claim 7, wherein:

said fastener is provided with a protective coating; and said aperture of said stress plate has a predetermined diametrical extent so that as said fastener, provided with said protective coating thereon, is axially inserted through said aperture, said aperture does not scrapingly engage said protective coating whereby said protective coating is retained upon said threaded fastener.

11. The assembly as defined in claim 7, wherein:

said sleeve means has a predetermined length so as to provide structural support to said plate for resisting pull through deformation of said plate and thereby prevent pull through of said fastener under adverse conditions impressed upon said stress plate.

12. The stress plate as set forth in claim 1, wherein:

said stress plate has a substantially circular configuration.

13. The stress plate as set forth in claim 1, wherein:

said substantially planar main body of said stress plate has a substantially circular configuration; and a substantially annular strengthening corrugation is defined within said substantially planar main body at a radial position interposed between said recessed portion and said outer peripheral edge.

14. The stress plate as set forth in claim 13, further comprising:

a plurality of radial rib segments interconnecting said substantially annular corrugation and said outer peripheral edge of said substantially planar main body.

15. The fastener assembly as set forth in claim 7, wherein:

said stress plate has a substantially circular configuration.

16. The fastener assembly as set forth in claim 7, wherein:

said substantially planar main body of said stress plate has a substantially circular configuration; and a substantially annular strengthening corrugation is defined within said substantially planar main body at a radial position interposed between said recessed portion and said outer peripheral edge.

17. The fastener assembly as set forth in claim 16, further comprising:

a plurality of radial rib segments interconnecting said substantially annular corrugation and said outer peripheral edge of said substantially planar main body.

18. A fastener assembly for securing a member to a base structure, comprising;

a threaded fastener having a head portion, a tip, and a threaded shank portion located between said tip and said head portion, wherein said threaded shank portion of said threaded fastener has a thread thereon having a predetermined pitch as defined between successive crest portions of said thread;

a stress plate having a substantially planar main body disposed within a first plane and having an outer peripheral edge vertically spaced from said first plane defined by said substantially planar main body so as to be disposed within a second plane whereby said stress plate, comprising said substantially planar main body and said outer peripheral edge, has a predetermined thickness dimension, and a recessed portion, having an upper portion commencing substantially within said first plane of said substantially planar main body and a lower portion terminating substantially within said second plane of said outer peripheral edge of said substantially planar main body such that said recessed portion has a depth substantially equal to said predetermined thickness dimension of said stress plate, defined within a substantially central portion of said stress plate for accommodating said head portion of said threaded fastener to be inserted through said stress plate in order to secure a member to a base structure;

an aperture defined within a substantially central portion of said stress plate and substantially coaxial with said recessed portion of said substantially planar main body for receiving said threaded shank portion of said threaded fastener; and a non-threaded, substantially cylindrical, tubular sleeve means, having opposite upper and lower ends, circumscribing said aperture, and having a predetermined axial length such that said upper end of said non-threaded, substantially cylindrical, tubular sleeve means is integral with said lower portion of said recessed portion of said substantially planar main body such that said non-threaded, substantially cylindrical, tubular sleeve means and said recessed portion of said substantially planar main body comprise a one-piece structure and said upper end of said non-threaded, substantially cylindrical, tubular sleeve means is disposed substantially within said second plane of said outer peripheral edge of said substantially planar main body while said lower end of said non-threaded, substantially cylindrical tubular sleeve means depends axially downwardly from said recessed portion of said substantially planar main body a predetermined distance below said second plane defined by said outer peripheral edge of said substantially planar main body, for receiving said threaded shank portion of said threaded fastener when said threaded fastener is inserted through said aperture defined within said substantially planar main body and for engaging only the crest portions of two successive crests of said thread of said threaded fastener when said threaded fastener is inserted through said aperture defined within said substantially planar main body so as to maintain said threaded fastener substantially perpendicular to said stress plate.

19. The assembly as defined in claim 18, wherein:

said sleeve means has a predetermined length so as to provide structural support to said plate for resisting pull through deformation of said stress plate and thereby prevent pull through of said fastener under adverse conditions impressed upon said stress plate.

20. The assembly as set forth in claim 18, wherein:

said substantially planar main body of said stress plate has a substantially circular configuration; and a substantially annular strengthening corrugation is defined within said substantially planar main body at a radial position interposed between said recessed portion and said outer peripheral edge.

* * * * *